US006637171B1

(12) United States Patent
Toone

(10) Patent No.: US 6,637,171 B1
(45) Date of Patent: Oct. 28, 2003

(54) APPARATUS AND METHOD FOR REINFORCING CONCRETE USING REBAR ISOLATORS

(76) Inventor: Bryan D. Toone, 1088 N. Portland Ave., Gilbert, AZ (US) 85234

( * ) Notice: Subject to any disclaimer, the term of this patent is extended or adjusted under 35 U.S.C. 154(b) by 0 days.

(21) Appl. No.: 10/123,432

(22) Filed: Apr. 16, 2002

Related U.S. Application Data

(60) Provisional application No. 60/330,296, filed on Oct. 17, 2001.

(51) Int. Cl.[7] ..... E04C 5/16

(52) U.S. Cl. ..... 52/677; 52/155; 52/679; 52/680; 52/681; 256/1; 256/21; 248/74.1; 248/71; 248/156; 248/530

(58) Field of Search ..... 52/677, 155, 679, 52/680, 681; 256/1, 21; 248/74.1, 71, 156, 530

(56) References Cited

U.S. PATENT DOCUMENTS

| | | | | | |
|---|---|---|---|---|---|
| 644,938 | A | * | 3/1900 | Orr | 52/680 |
| 880,992 | A | * | 3/1908 | Hayes | 52/297 |
| 1,435,429 | A | * | 11/1922 | Sullivan | 52/680 |
| 4,388,791 | A | | 6/1983 | Anderson | |
| 4,575,985 | A | | 3/1986 | Eckenrodt | |
| 4,598,523 | A | | 7/1986 | Tolliver | |
| 5,509,636 | A | | 4/1996 | Cotugno | |
| 5,568,785 | A | * | 10/1996 | Hazen | 116/209 |
| 5,699,642 | A | | 12/1997 | McDevitt, Jr. | |
| 6,047,515 | A | | 4/2000 | Behlen | |
| 6,115,987 | A | | 9/2000 | Tatum | |

* cited by examiner

*Primary Examiner*—Carl D. Friedman
*Assistant Examiner*—Steve Varner
(74) *Attorney, Agent, or Firm*—Wright Law Group, PLLC; Mark F. Wright

(57) ABSTRACT

According to the preferred embodiments of the present invention, an apparatus and method for suspending rebar is disclosed. The rebar isolator of the present invention comprises a pointed metal spike or stake with one or more hollow-bodied rebar supports. Each of the hollow-bodied rebar supports has a support arm which supports the horizontally-positioned rebar. In addition, the spike or stake portion of the rebar isolator has a number of crimped zones which prevent the support arms from shifting downward or rotating in place when the concrete is poured over the horizontally-positioned rebar. The number of crimped zones corresponds to the number of hollow-bodied cylindrical rebar isolator supports and one crimped zone is located immediately below each of the support arms.

20 Claims, 3 Drawing Sheets

APPARATUS AND METHOD FOR REINFORCING CONCRETE USING REBAR ISOLATORS

RELATED APPLICATION

This application claims the benefit of U.S. Provisional application No. 60/330,296, filed on Oct. 17, 2001.

BACKGROUND OF THE INVENTION

1. Technical Field

The present invention relates to suspending and positioning metal reinforcing bars (rebar) in the footings and foundations of buildings and other structures.

2. Background Art

The use of rebar in reinforced concrete structures, and in particular, concrete structures in which the reinforcing steel has a connection with surrounding earth, is well known. The typical application is usually typified by the placement of rebar in the footings or foundations utilized in homes, commercial buildings, or other concrete structures. The long time practice for utilizing rebar in the construction of the footing or other foundational support system for building and the like is to dig a trench in the ground and, in order to impart tensile strength to the concrete which will fill the trench and constitute the footing, suspend one or more horizontally-positioned layers of steel reinforcing bars within the trench.

To impart the necessary tensile strength to the footing, these reinforcing bars, typically called "rebar," are usually laid at a height above the ground which is generally ⅓ to ½ the total resultant height of the concrete footing. For example, if a concrete footing is to be 12 inches in depth, the rebar would lie at a distance of approximately 3 to 5 inches from the bottom surface of the concrete, and thus 3 to 5 inches above the bottom of the dug trench. The common practice is to drive a vertical stake into the ground at the bottom of the trench, and then attach a row of horizontally-positioned rebar at the proper height using a piece of wire wrapped crossways around both the stake and the horizontally-positioned rebar.

In addition, it has been common practice to use a short piece of rebar as the vertical stake since it may be pounded easily into the ground, and provides the necessary strength to hold the horizontal rebar in place against the force of the concrete as it is poured around the horizontal rebar and the vertical stake.

Although the above-mentioned practices are convenient and well accepted in the construction industry, they are not without problems. One of the most significant issues is the amount of time that is required to place the rebar supports in place. Since the placement of the rebar is a manual process, it can be very time-consuming to place and tie each section of rebar in place. Additionally, the use of wire to tie the rebar in place can provide for less than optimal stability. In some cases, the wire is not tied securely and the weight of the concrete being poured over the horizontally-positioned rebar can cause the rebar to dislodge and move out of position. Alternatively, the rebar may shift or rotate in place, further destabilizing the rebar support system. If this happens, the structural integrity of the concrete foundation or structure can be comprised. Any such undesirable movement of the horizontally-positioned rebar requires an even more time-consuming operation to retrieve the horizontally-positioned rebar and replace it in the proper location. Accordingly, without an improvement in rebar support systems which provide an inexpensive, quick and easy installation process while also maintaining the requisite stability, the placement of rebar in foundations will continue to be sub-optimal.

DISCLOSURE OF INVENTION

According to the preferred embodiments of the present invention, an apparatus and method for suspending rebar is disclosed. The rebar isolator of the present invention comprises a pointed metal spike or stake with one or more hollow-bodied rebar supports. Each of the rebar supports has at least one support arm which supports the horizontally-positioned rebar. In addition, the spike or stake portion of the rebar isolator has a number of crimped zones which prevent the hollow-bodied rebar supports from shifting downward or rotating in place when the concrete is poured over the horizontally-positioned rebar. The number of crimped zones corresponds to the number of hollow-bodied rebar isolator supports and one crimped zone is located immediately below each of the support arms. One embodiment employs multiple rebar supports such that multiple pieces of rebar can be positioned in parallel, with each piece of rebar occupying space in substantially the same vertical plane as every other piece of rebar.

BRIEF DESCRIPTION OF DRAWINGS

The preferred embodiments of the present invention will hereinafter be described in conjunction with the appended drawings, wherein like designations denote like elements, and.

BEST MODE FOR CARRYING OUT THE INVENTION

1. Detailed Description

Figure 1:
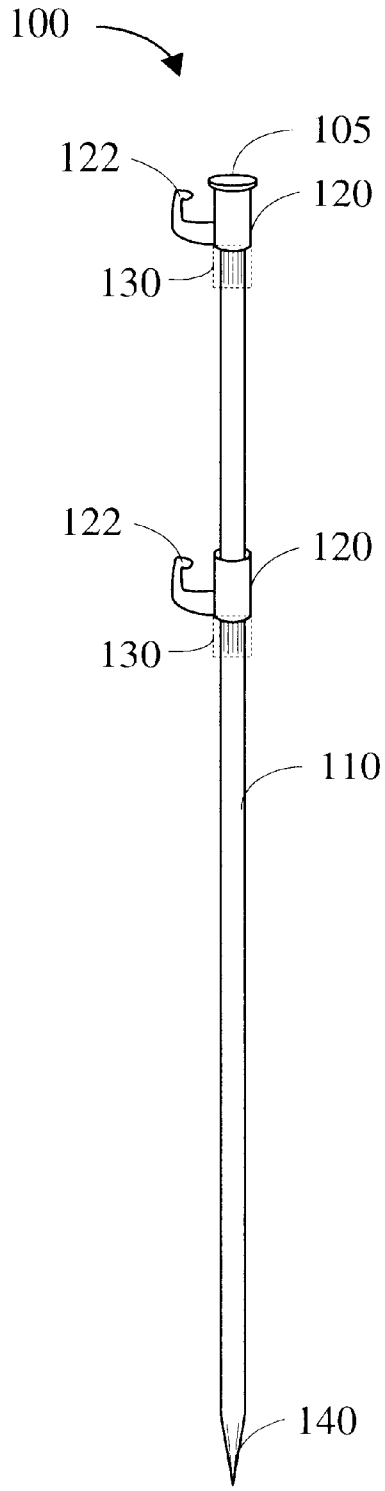
FIG. 1 is a perspective view of a rebar isolator according to a preferred embodiment of the present invention.

Referring now to FIG. 1, a rebar isolator 100 according to a preferred embodiment of the present invention is shown. Rebar isolator 100 comprises: a stake portion 110 and at least one hollow-bodied rebar support 120. Stake portion 110 includes a cap portion 105; at least one crimped zone 130 formed in the body of stake portion 110; and a pointed end 140. Support arm 122 is an integral part of hollow-bodied rebar support 120.

By applying a force to cap portion 105, such as striking cap portion 105 with a hammer, mallet, or other tool, pointed end 140 will penetrate the surface of the ground at a desired location within the foundation trench or other desired location where the rebar is to be positioned. Alternatively, force could be applied to cap portion 105 by means of a press or other machine with sufficient power to drive pointed end 140 into the ground. Each of the hollow-bodied rebar supports 120 are designed to support a single piece of rebar and are used to suspend the rebar in place. When placed into the support arm 122 or hollow-bodied rebar supports 120, any two pieces of rebar supported by the support arm portions 122 of hollow-bodied rebar supports 120 will be substantially co-planar in the same vertical plane with the other pieces of rebar that have been placed into other hollow-bodied rebar supports 120.

Additionally, in the most preferred embodiments of the present invention, support arms 122 of hollow-bodied rebar support 120 are substantially L-shaped. Cap portion 105 provides a substantial surface which is used to drive rebar isolator 100 into the ground. Cap portion 105 and stake portion 110 are manufactured as an integral unit and preferably formed from a hard, metallic material such as steel or iron.

In the most preferred embodiments of the present invention, each of the hollow-bodied rebar supports 120 has a generally circular shape with the L-shaped support arm 122 attached to a portion of hollow-bodied rebar support 120. In this configuration, the spike or stake portion 110 is also substantially circular and the outer diameter of the spike or stake portion 110 is slightly smaller than the inner diameter of the opening through the body of hollow-bodied rebar support 120.

Figure 2:
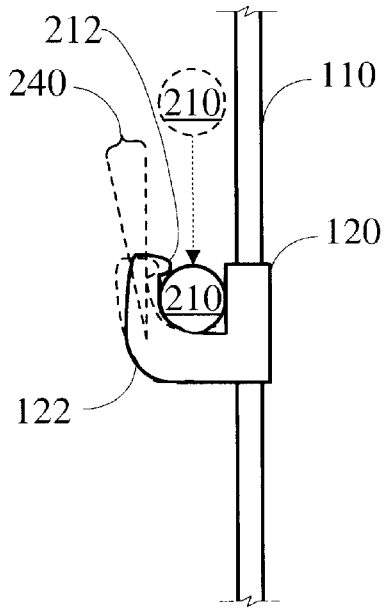
FIG. 2 is a side view of a portion of the rebar isolator of FIG. 1, shown with a piece of rebar being inserted in to a support arm.

Referring now to FIG. 2, a side view of a hollow-bodied rebar support 120 according to a preferred embodiment of the present invention is shown. Hollow-bodied rebar support 120 comprises a hollow substantially cylindrical body with an interior diameter sized to closely approximate, yet be slightly larger than, the outer diameter of stake portion 110 and a support arm 122. Although tightly fitted, if enough pressure is applied, hollow-bodied rebar support 120 may slide along the surface of stake portion 110. In the most preferred embodiments of the present invention, hollow-bodied rebar support 120 are manufactured from a durable, resilient, hard plastic material. While the plastic material selected must be fairly hard, a brittle plastic may not withstand the weight and pressure of the concrete pouring in place and may shatter.

Because the selected material is resilient, it is also soft enough to be scored, given the application of enough force and pressure. Those skilled in the art will be familiar with the types of plastic useful in this specific application. Crimped zones 130 are formed by applying mechanical pressure to a die around the circumference of the surface of stake portion 110 at a certain point, thereby forming a series of lands and grooves around the circumference of stake portion 110. The width of crimped zone 130 can vary. At least a portion of the lands and grooves will have edges sharp enough to score the plastic of hollow-bodied rebar support 120. As shown below in conjunction with FIG. 3, Crimped zones 130 serve to ensure that hollow-bodied rebar supports 120 will not inadvertently slide down the body of stake portion 110.

Rebar support portion 122 is formed as an integral part of hollow-bodied rebar support 120 at the time of manufacture and further comprises a raised portion 212. Raised portion 212 is a slight protrusion that slightly restricts and constrains a piece of rebar 210 when rebar 210 is inserted into the opening formed by rebar support portion 122. As shown in FIG. 2, rebar 210 may be inserted into hollow-bodied rebar support 120 by applying downward pressure and forcing rebar 210 down and into the opening formed by rebar support portion 122 and the surface of the cylindrical body of hollow-bodied rebar support 120.

Raised portion 212 marginally resists the entry of rebar 210 because the horizontal distance between raised portion 212 and the surface of the cylindrical body of hollow-bodied rebar Support 120 is slightly less that the diameter of rebar 210. However, since hollow-bodied rebar support 120 is made from a slightly flexible material, rebar support portion 122 can be moved slightly away from the cylindrical body of hollow-bodied rebar support 120 if enough downward pressure is applied to rebar 210. As shown in FIG. 2, rebar support portion 122 will deflect a small distance 240 when downward pressure is applied to rebar 210. After rebar 210 has been inserted, raised portion 212 will "snap" back into its original position, thereby "locking" or holding rebar 210 in position.

Figure 3:
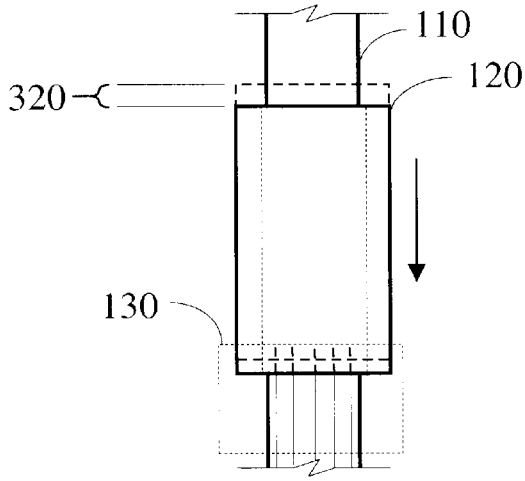
FIG. 3 is a side view of a portion of the rebar isolator of FIG. 1, shown in a first and second position.

Referring now to FIG. 3, a side view of the interaction between the cylindrical body of hollow-bodied rebar support 120 and crimped zone 130 is depicted. When originally manufactured, each hollow-bodied rebar support 120 is positioned on stake portion 110 at a location just above crimped zone 130. In practical application, after rebar isolator 100 is pounded into place and rebar 210 is positioned into the opening formed by rebar support portion 122 and the cylindrical body of hollow-bodied rebar supports 120, concrete is poured into the foundation space, thereby surrounding rebar isolators 100 with concrete. The weight of the concrete pouring over rebar 210 and hollow-bodied rebar supports 120 will apply a downward force on the entire assembly, including rebar 210 as supported by rebar isolators 100.

Without the use of crimped zones 130, this downward force and pressure may cause hollow-bodied rebar supports 120 to move vertically downward to a position slightly lower than its original position, thereby compromising the integrity of the resulting foundation. By utilizing crimped zones 130, any downward force or pressure will cause at least a portion of the body portion of hollow-bodied rebar support 120 to engage at least a portion of the lands and grooves of crimped zone 130. Once thus engaged, hollow-bodied rebar support 120 is fixed firmly in position and, correspondingly, rebar 210 is fixed firmly in position. Although hollow-bodied rebar support 120 moves from a first position to a second position, thereby engaging at least a portion of the crimped zone, this movement is quite small when compared to the overall length of stake portion 110 and the overall size of crimped zone 130.

Figure 4:
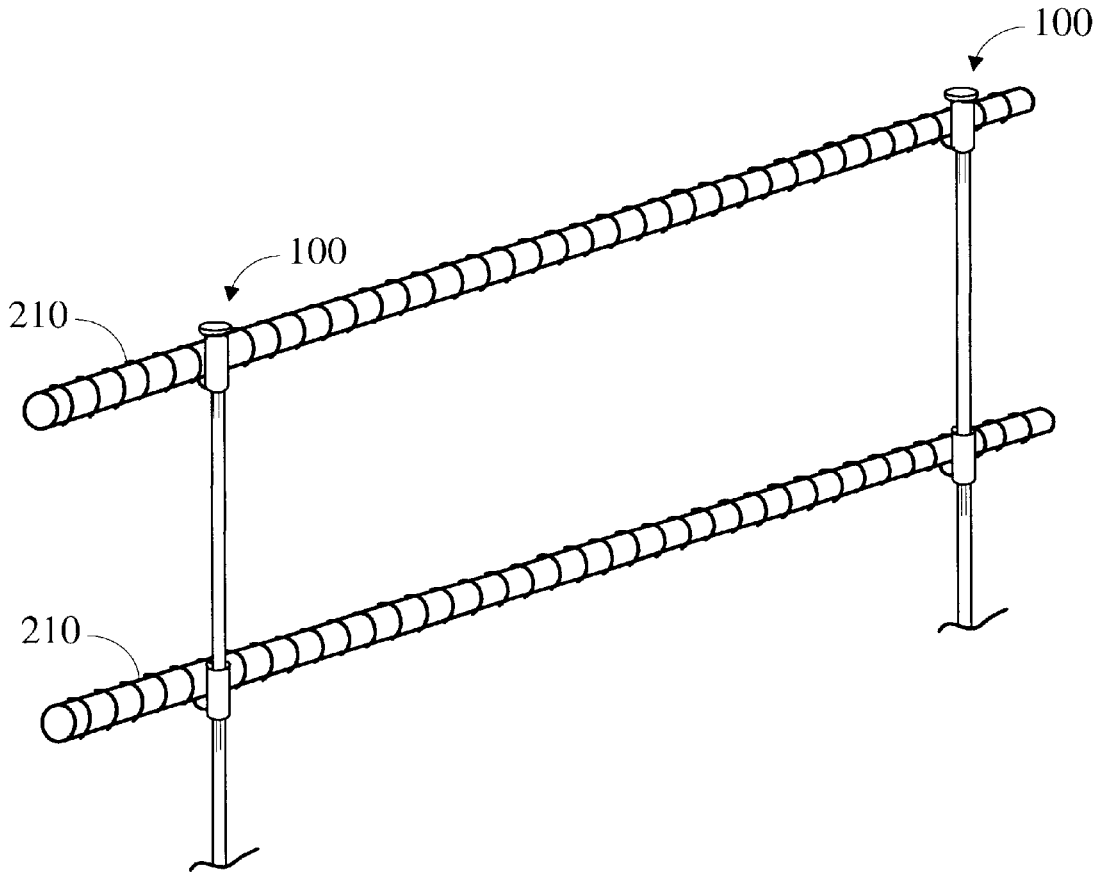
FIG. 4 is a perspective view of the rebar isolator of FIG. 1, deployed to support rebar in a typical application.

Referring now to FIG. 4, a perspective view of a typical application using rebar isolator 100 is shown. As shown in FIG. 4, two pieces of rebar 210 are horizontally suspended in hollow-bodied rebar supports 120. Although only two rebar isolators 100 are shown, in a typical application, dozens or even hundreds of rebar isolators 100 would be lined up so as to support any desired length of rebar 210.

As shown in FIG. 4, both pieces of rebar 210 are suspended such that they are parallel to each other and occupy space in substantially the same vertical plane. In yet another preferred embodiment of the present invention, additional pieces of rebar could be suspended in the same fashion, using additional rebar isolators 100.

In summary, rebar isolator 100 comprises a rebar support portion 122, working in concert with the cylindrical body portions of hollow-bodied rebar supports 120 and crimped zones 130, to firmly and securely suspend rebar 210 in place, thereby ensuring stable and secure reinforcement for a concrete foundation. In addition, the use of rebar support portions 122 to hold rebar 210 in place allows a worker to quickly and easily place rebar in position within a foundation or footing trench by dispensing with the traditional use of tie wires. This is especially important in applications where multiple pieces of rebar are being placed in parallel because substantial times savings can be realized when the labor-intensive effort of tying each individual piece of rebar in place is circumvented.

While the preferred exemplary embodiments have been presented in the foregoing detailed description, it should be appreciated that a vast number of variations exist. It should also be appreciated that the preferred embodiments described herein are only representative in nature and are not intended to limit the scope, applicability, or configuration of the invention in any way. Rather, the foregoing detailed descriptions provides those skilled in the art with a convenient roadmap for implementing the preferred exemplary embodiments of the present invention. It should be understood that various changes may be made in the function and arrangement of elements described in the exemplary preferred embodiments without departing from the spirit and scope of the invention as set forth in the appended claims.

What is claimed is:

1. A reinforced concrete slab comprising at least one rebar isolator embedded within said reinforced concrete slab, said at least one rebar isolator comprising:

a spike portion, said spike portion comprising a body, a first end, a second end, and at least one crimped zone, said at least one crimped zone being formed in said body between said first end and said second end; and at least one hollow-bodied rebar support, said hollow-bodied rebar support having a support arm, said support arm being adapted to receive a piece of rebar, wherein said at least one hollow-bodied rebar support is positioned on said body between said cap portion and said at least one crimped zone.

2. The apparatus of claim 1 wherein said support arm further comprises a raised portion, said raised portion defining a distance, said distance being slightly smaller than a diameter of said piece of rebar.

3. The apparatus of claim 1 wherein said first end comprises a pointed end and said second end comprises a cap portion.

4. The apparatus of claim 1 wherein said spike portion comprises a hardened steel spike.

5. The apparatus of claim 1 wherein said support arm is substantially L-shaped.

6. The apparatus of claim 1 wherein said hollow-bodied cylindrical rebar support comprises a hard plastic hollow-bodied cylindrical rebar support.

7. The apparatus of claim 1 wherein said at least one crimped zone comprises a series of lands and grooves.

8. A method comprising the steps of:

providing at least one rebar isolator, said at least one rebar isolator comprising;

a stake portion, said stake portion comprising a body portion, said body portion comprising at least one crimped zone, a first end and a second end, said first end comprising a pointed end and said second end comprising a cap portion, at least one hollow-bodied rebar support, said hollow-bodied rebar support comprising a rebar support portion, said at least one hollow-bodied rebar support being positioned on said body portion between said cap portion and said at least one crimped zone, said rebar support portion being adapted to support at least one piece of rebar, driving said pointed end of said stake portion into a desired location by applying a force to said cap portion;

inserting said at least one piece of rebar into said at least one hollow-bodied rebar support; and pouring concrete over and around said at least one rebar isolator and said at least one piece of rebar, thereby substantially covering said at least one rebar isolator and said at least one piece of rebar.

9. The method of claim 8 wherein said step of inserting at least one piece of rebar into at least one rebar isolator comprises the step of inserting a plurality of pieces of rebar into a plurality of rebar isolators.

10. The method of claim 8 wherein:

said rebar support portion further comprises a raised portion; and said step of inserting said at least one piece of rebar into said at least one hollow-bodied rebar support comprises the step of applying downward pressure on said at least one piece of rebar, thereby deflecting said raised portion of said rebar support portion.

11. The method of claim 9 further comprising the step of pouring concrete over and around said plurality of rebar isolators and said plurality of pieces of rebar, thereby substantially covering said plurality of rebar isolators and said plurality of pieces of rebar.

12. The method of claim 8 wherein said step of pouring concrete over and around said at least one rebar isolator and said at least one piece of rebar forces said at least one hollow-bodied rebar support to move from a first position to a second position such that at least a portion of said hollow-bodied rebar support engages at least a portion of said at least one crimped zone.

13. A rebar isolator comprising:

a spike portion, said spike portion comprising:

a body, a first end, a second end, a first crimped zone and a second crimped zone, said first and second crimped zones being formed in said body between said first end and said second end, said first end comprising a pointed end and said second end comprising a cap portion;

a first hollow-bodied rebar support and a second hollow-bodied rebar support, each of said first and second hollow-bodied rebar supports comprising an L-shaped rebar support portion, each of said L-shaped rebar support portions being adapted to support a piece of rebar, said piece of rebar defining a diameter, each of said L-shaped rebar support portions comprising a raised portion and each of said raised portions defining a distance less than said diameter of said piece of rebar;

wherein said first hollow-bodied rebar support is positioned on said body portion of said spike between said cap portion and said first crimped zone and said second hollow-bodied rebar support is positioned on said body portion of said spike between said first crimped zone and said second crimped zone.

14. The rebar isolator of claim 13 wherein each of said first and second crimped zones comprises a series of lands and grooves.

15. The rebar isolator of claim 13 wherein said hollow-bodied cylindrical rebar support comprises a hard plastic hollow-bodied cylindrical rebar support.

16. The rebar isolator of claim 13 wherein said spike portion comprises a hardened steel spike.

17. A method of supporting a first and second piece of rebar in a trench comprising the steps of:

providing from a plurality of rebar isolators at least a first rebar isolator and a second rebar isolator, wherein each of said plurality of rebar isolators comprises;

a stake portion, said stake portion comprising a body portion, said body portion comprising a first crimped zone, a second crimped zone, a first end and a second end, said first crimped zone and said second crimped zone being formed in said body portion between said first end and said second end, said first end comprising a pointed end and said second end comprising a cap portion, a first hollow-bodied rebar support and a second hollow-bodied rebar support, said first and second hollow-bodied rebar supports each comprising a rebar support portion, each of said rebar support portions being adapted to support either of said first and second pieces of rebar, said first hollow-bodied rebar support being positioned on said body portion between said cap portion and said first crimped zone, said second hollow-bodied rebar support being positioned on said body portion between said first crimped zone and said second crimped zone, driving said pointed end of said first rebar isolator into a first desired location within said trench by striking said cap portion of said first rebar isolator with a hammer;

driving said pointed end of said second rebar isolator into a second desired location within said trench by striking said cap portion of said second rebar isolator with said hammer;

inserting a first piece of rebar into said first rebar isolator;

inserting a second piece of rebar into said second rebar isolator;

pouring concrete over and around said first and second rebar isolators and said first and second pieces of rebar, thereby substantially covering said first and second rebar isolators and said first and second pieces of rebar.

18. The method of claim 17 further comprising the step of driving additional rebar isolators from said plurality of rebar isolators into a plurality of desired locations within said trench and inserting a plurality of additional pieces of rebar into said plurality of additional rebar isolators in substantially the same fashion as said first and second pieces of rebar.

19. The method of claim 18 wherein said steps of inserting said first and second pieces of rebar into said first and second rebar isolators comprises the steps of suspending said first and second pieces of rebar into said first and second rebar isolators, thereby placing said first and second pieces of rebar into a position where said first and second pieces of rebar are substantially parallel to each other and are in the same vertical plane.

20. The reinforced concrete slab of claim 1 wherein said at least one hollow-bodied rebar support comprises:

a first hollow-bodied rebar support, said first hollow-bodied rebar support having a first support arm, said first support arm being adapted to receive a first piece of rebar; and a second hollow-bodied rebar support, said second hollow-bodied rebar support having a second support arm, said second support arm being adapted to receive a second piece of rebar, wherein said first hollow-bodied rebar support and said second hollow-bodied rebar support arc positioned on said body between said first end and said second end.

* * * * *